US005697157A

United States Patent [19]

Votolato

[11] Patent Number: 5,697,157

[45] Date of Patent: Dec. 16, 1997

[54] HEAVY-DUTY BOX OPENER

[75] Inventor: Earl Votolato, Newport Beach, Calif.

[73] Assignee: Spellbound Development Group, Newport Beach, Calif.

[21] Appl. No.: 712,595

[22] Filed: Sep. 13, 1996

[51] Int. Cl.[6] ..... B26B 3/08

[52] U.S. Cl. ..... 30/2; 30/294

[58] Field of Search ..... 30/2, 294, 317, 30/337, 286

[56] References Cited

U.S. PATENT DOCUMENTS

| | | | |
|---|---|---|---|
| 365,714 | 6/1887 | Warner | 30/286 |
| 2,376,887 | 5/1945 | Walters | 30/151 |
| 2,730,800 | 1/1956 | Bailey | 30/82 |
| 2,743,523 | 5/1956 | Honey | 30/2 |
| 3,430,339 | 3/1969 | Hobson | 30/2 |
| 3,781,988 | 1/1974 | Jones | 30/2 |
| 4,531,286 | 7/1985 | Vito et al. | 30/2 |
| 4,675,996 | 6/1987 | DuBuque | 30/2 |
| 5,234,436 | 8/1993 | Eaton et al. . | |
| 5,241,750 | 9/1993 | Chomiak | 30/2 |

*Primary Examiner*—Hwei-Siu Payer

*Attorney, Agent, or Firm*—William W. Haefliger

[57] ABSTRACT

A slitter comprising a blade having a cutting edge; a holder with blade, including a handle, and a terminal on the handle retaining the blade with the blade edge protruding; and a shield carried by the holder proximate the terminal, for movement between extended position in which the blade is protected, and retracted position in which the blade edge is exposed for cutting, the shield having two side plates movable adjacent opposites sides of the terminal, protective structure extending between the plates to extend beyond the blade in shield extended position, and a retainer interconnecting the plates, there being a pivot interconnection between the plates and the holder, proximate the retainer.

13 Claims, 3 Drawing Sheets

HEAVY-DUTY BOX OPENER

BACKGROUND OF THE INVENTION

This invention relates generally to slitting devices, as are used for opening boxes, and more particularly, to an improved device of simple, compact, heavy duty lightweight construction and enabling its throw-away disposal.

There is need for devices, as referred to above, and in particular, there is need for very low cost such devices which are made to be thrown away without danger, which could otherwise be presented by slitting blade exposure. The device disclosed herein improves over that of U.S. Pat. No. 5,522,135, incorporated herein by reference.

SUMMARY OF THE INVENTION

It is a major object to provide an improved box opener in the form of a slitting device of simple, low cost, compact, throw-away construction, and which is safe to use, and safe when thrown away by virtue of blade protection. Basically, the device comprises:

a) a blade having a cutting edge, b) a holder for the blade, including a handle, and a terminal on the handle retaining the blade with the blade edge protruding, c) and a shield carried by the holder proximate said terminal, for movement between extended position in which the blade is protected, and retracted position in which the blade edge is exposed for cutting, d) the shield having two side plates or walls movable adjacent opposites sides of the terminal. Protective structure extends between the plates at their forward ends, and a retainer such as a cross-piece interconnects said plates, there being a pivot interconnection between said plates and said holder, proximate the retainer.

As will be seen, the holder typically includes a blade retaining insert plate carried by the terminal, the blade carried adjacent the insert plate with the blade edge projecting in skewed relation to lower corners of the side plates interconnected by the retainer, in shield retracted position.

It is another object to provide the shield side plates with lower edges that extend below the skewed blade cutting edge and insert lower edge, in shield-extended position. In this regard the retainer is typically a cross-piece integral with the shield side plates, and which remains near an edge of the holder and near the pivot location during pivoting of the shield between said extended and retracted positions. Also the shield side plates typically have integral connection spaced from the cross-piece to move together. The blades and shield may consist of molded plastic material, whereby the holder, shield and blade are of throw-away construction.

A further object is to provide the holder terminal with flat, opposite sides in sliding engagement with said side plates, said shield defining edges adapted for stabilizing engagement with a surface to be slit.

Yet another object is to provide a stop on the holder limiting shield movement toward extended position. As will be seen, the stop is near the retainer.

A further object is to provide the terminal with a first, flat, shallow recess, the insert plate received in the first recess, the blade having a first portion received in that recess and a second portion protruding edgewise from that recess, with the blade cutting edge skewed relative to a lower edge defined by the insert plate, the terminal also defines a shallow second recess receiving a portion of the blade, there being retention rivet means extending through the recesses, the blade, the insert plate and said terminal. As will be seen, the blade first portion is typically confined between a wall defined by said insert plate and a wall defined by said handle terminal portion.

The opener may consist of lightweight, plastic construction, for throw-away after use.

These and other objects and advantages of the invention, as well as the details of an illustrative embodiment, will be more fully understood from the following specification and drawings, in which:

DRAWING DESCRIPTION

DETAILED DESCRIPTION

Figure 1:
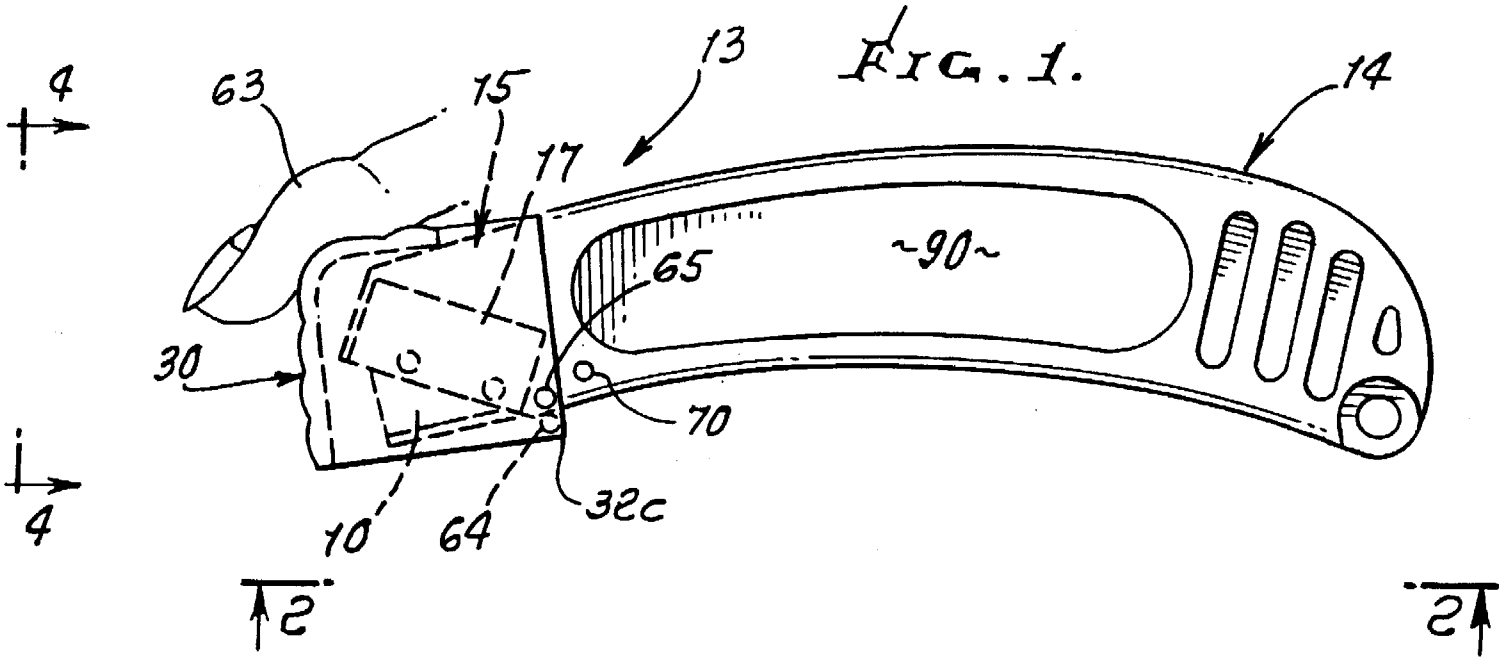
FIG. 1 is a left-side view of the device of the invention, with the blade shield in extended position.

In the drawings, a thin, metallic, generally rectangular blade 10 has a lower, straight cutting edge 11, for slitting a panel 12. The latter may be provided by a pasteboard box, or other item needing slitting, as for opening.

Figure 7:
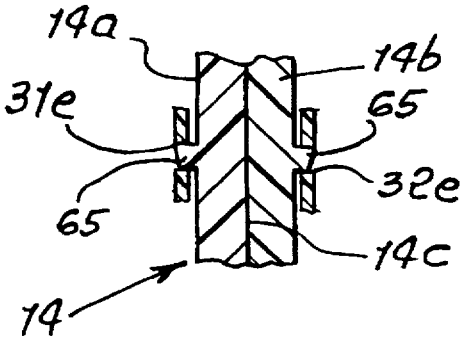
FIG. 7 is a section taken through the body to show interconnected plastic body section, and two pivots.

A holder 13 for the blade includes an elongated handle 14, which may be curved, as shown and have side cutouts 90. The handle typically consists of low-cost molded plastic material, adapted for throw-away after the device is used. FIG. 7 shows two plastic handle sections **14*a* and 14*b* adhesively connected at plane 14*c*. The handle has a curved terminal portion 15 at which the blade is retained. Terminal portion 15 defines a first, shallow, flat, generally rectangular recess 16 to receive a flat, rectangular insert plate 17, which may consist of plastic material, and may be adhesively bonded to the plastic handle terminal portion. Recess 16 is bounded on three sides by linear shoulders 18, 19 and 20 closely confining corresponding edges of plate 17**.

Figure 5:
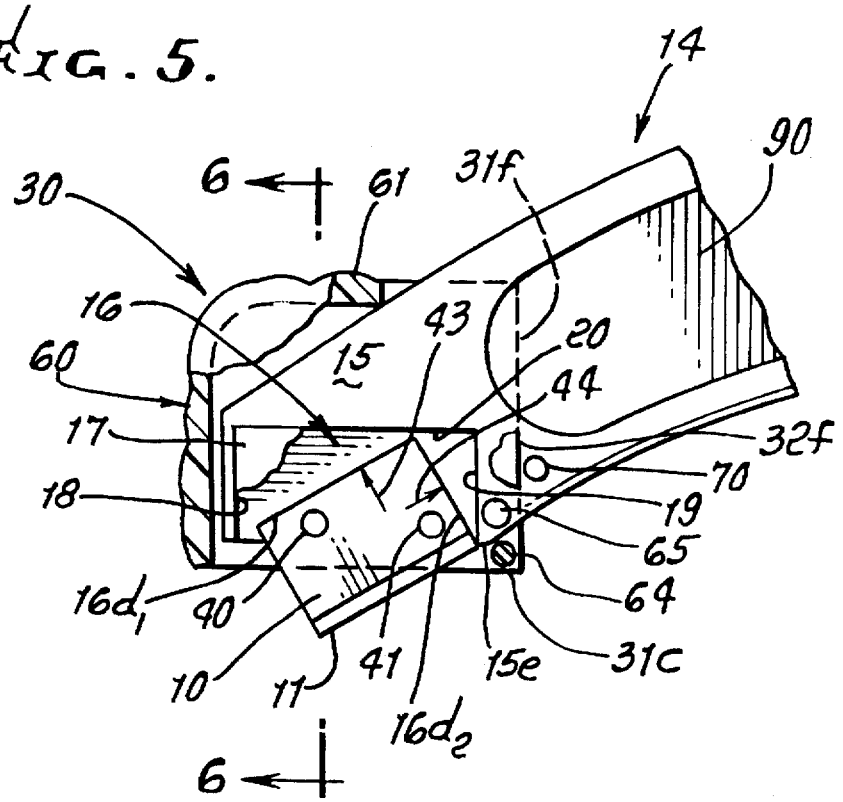
FIG. 5 is an enlarged fragmentary view, partially cut away to show internal construction.
Figure 6:
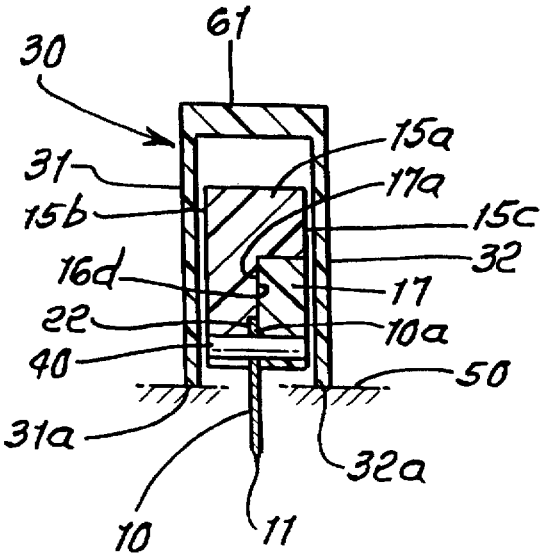
FIG. 6 is a section taken on lines 6—6 of FIG. 5.

The insert plate 17 has an inner side **17*a* seating flatly against the inner wall 16*d* of recess 16, as shown in FIG. 6. Plate 17 may be adhesively connected to terminal wall 16*d*, and in addition rivets 40 and 41 connect the plate to handle terminal portion 15*a*, in the manner seen in FIG. 6. This construction affords sturdy, stable positioning and locating of blade 10, the upper portion 10*a* of which is received in a shallow second recess 22 sunk in wall 16*d*. That recess has edges seen at $16d_1$, and $16d_2$, in FIG. 5, to edgewise confine the blade upper edges to transfer loading directly to the handle terminal 15, during cutting, and in angled directions indicated by arrows 43 and 44, in FIG. 5, for enhanced stability. Note in FIG. 6 the flat stable engagement of opposite sides of the blade with surfaces of the insert plate and of the second recess, the rivets 40 and 41** extending through those elements, further enhancing stability.

Figure 3:
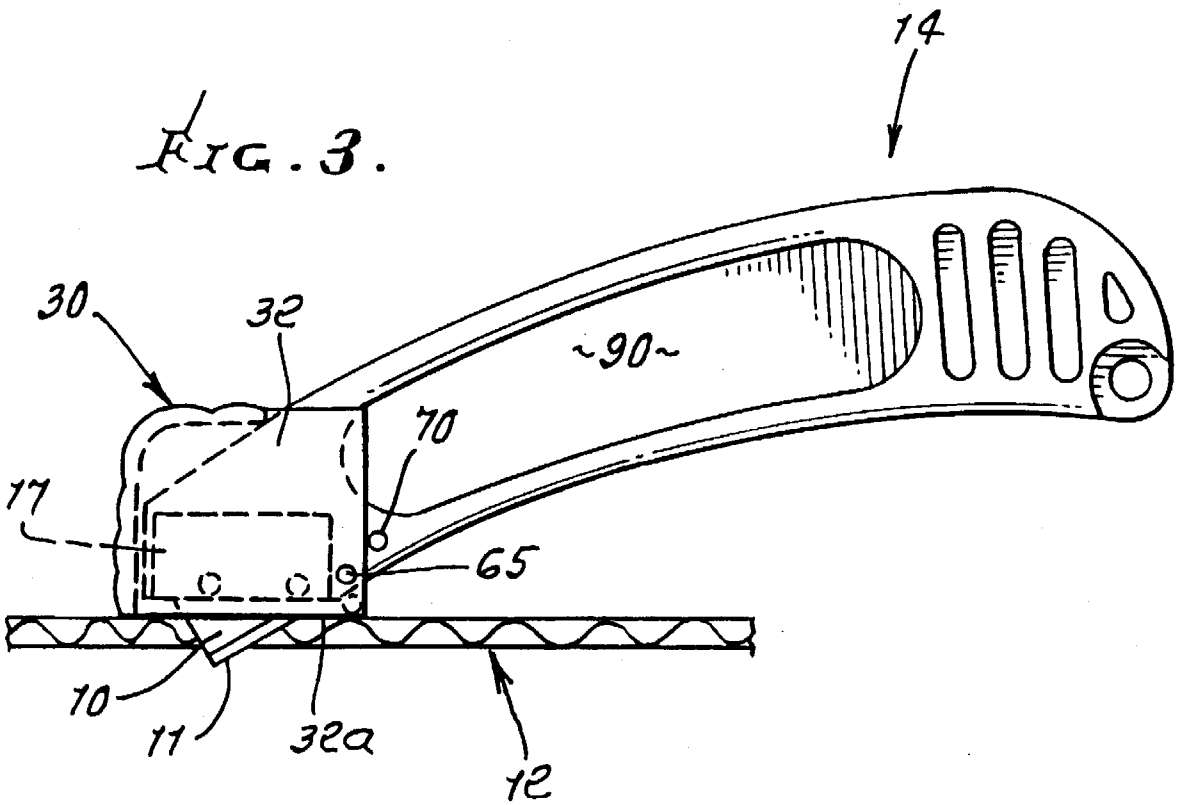
FIG. 3 is a view like FIG. 1, but showing the exposed blade, in box cutting use.
Figure 4:
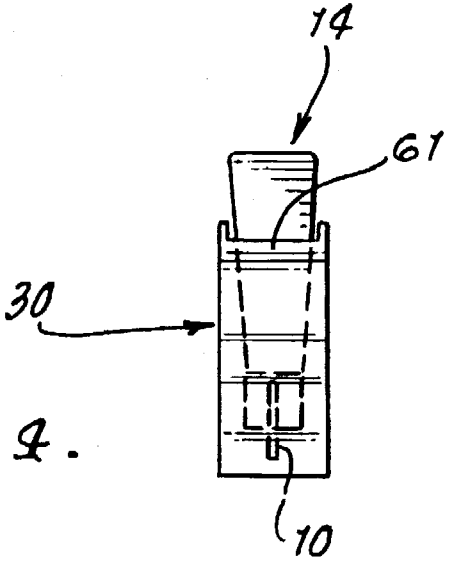
FIG. 4 is an end view taken on lines 4—4 of FIG. 1.

A shield 30 (of molded plastic construction) is carried by the holder 13, proximate terminal 15, for movement between extended position in which the blade is protected (see FIG. 1) and retracted position (see FIG. 3) in which the blade edge 11 is exposed for cutting. The shield has two parallel side plates or wall sections 31 and 32 at opposite sides of the terminal 15, with edges **31*a* and 32*a* that are adapted to ride on a surface 50 to be slit, as seen in FIG. 6. The wide spacing of edges 31***a* and 32*a* assures stability, during slitting, holding blade 10 normal to that surface.

The thin side plates 31 and 32 are positioned to travel closely adjacent opposite sides 15*b* and 15*c* of the terminal, and to be held in position, as by protective structure extending between those plates. See for example interconnecting webbing 60 extending at the front or nose of the shield, and 61 extending at the upper side of the shield. Such webbing may have an undulated outer surface for engagement by the user's finger that pushes i.e. pivots the shield back down over the blade, to FIG. 1 position, after cutting. See the forefinger 63 in FIG. 1.

A pivot means interconnection between the shield side plates and the holder is provided, proximate a retainer 64 that extends between and integral with the side plates near their lower edges. That retainer assists in keeping or holding the plate adjacent the opposite sides 15*b* and 15*c* of the terminal 15. The retainer 64 is near the pivots 65, and at corners 31*c* and 32*c* of the side plate that remain near the terminal 15, during shield retraction, as is clear from FIG. 5. Therefore, the shield is retained on the terminal 15, in all shield positions. Note the blade edge 11 extending in skewed relation to the corners 31*c* and 32*c*, but out of engagement with the retainer 64. That retainer may also engage the underside 15*e* of the terminal, in shield retracted position. See FIG. 3.

The shield pivot means advantageously includes the two trunnions 65 projecting from opposite sides of the body sections 14*a* and 14*b* (see FIG. 7), for reception through openings 31*e* and 32*e* in the shield side plates. Retainer 64 keeps those side plates from spreading free of the pivot trunnions.

Figure 2:
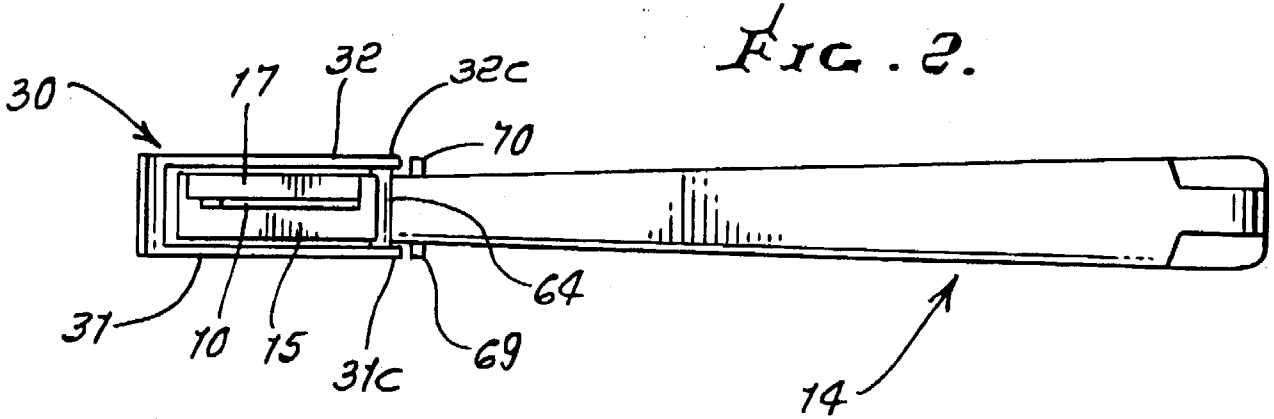
FIG. 2 is a bottom view taken on lines 2—2 of FIG. 1.

Stop trunnions 69 and 70 are also provided on the body sections 14*a* and 14*b* as shown in FIG. 2. They are engaged by the shield side plate edges 31*f* and 32*f*, in shield retracted position, to limit such retraction. Retainer 64 keeps the side plates from spreading to an extent that they would over-ride these stops.

The device of the invention is highly compact, made of molded plastic, is of low-cost construction, and is adapted for throw away after use. At the same time, the blade is firmly retained and is well protected by the shield, except during use to slit pasteboard, as referred to, whereby the device is very safe.

The present device incorporates improvements over that of my prior device as disclosed in U.S. Pat. No. 5,522,135, and is particularly adapted for heavy duty use.

I claim:

1. In a slitter, the combination comprising a) a blade having a cutting edge;

b) a holder for the blade, including a handle, and a terminal on the handle retaining the blade with the blade edge protruding, c) and a shield carried by the holder proximate said terminal, for movement between extended position in which the blade is protected, and retracted position in which the blade edge is exposed for cutting, d) the shield having two side plates movable adjacent opposite sides of said terminal, protective structure extending between said plates to extend beyond said blade in shield extended position, and a retainer interconnecting said plates, there being a pivot interconnection between said plates and said holder, proximate said retainer, e) the holder including an insert plate carried by said terminal, the blade carried adjacent the insert plate with the blade edge projecting in skewed relation to lower corners of the side plates interconnected by said retainer, in shield retracted position, f) said shield side plates having lower edges that extend below the blade cutting edge in shield extended position, g) said terminal having flat, opposite sides in sliding engagement with said side plates, said shield defining edges adapted for stabilizing engagement with a surface to be slit, h) and wherein said terminal defines a flat, shallow first recess, the insert plate received in the first recess, the blade having a first portion received in said recess and a second portion protruding edgewise from that recess, with said cutting edge skewed relative to a lower edge defined by the insert plate, said terminal also defining a shallow second recess receiving a portion of the blade, there being retention rivet means extending through the recesses, the blade, the insert plate and said terminal.

2. The combination of claim 1 wherein said lower edge defined by the insert plate is adapted to ride on a panel being cut by said protruding second portion of the blade.

3. The combination of claim 1 wherein the handle and the insert plate consist of molded plastic material, the insert plate adheringly connected to said handle terminal.

4. The combination of claim 1 wherein the blade first portion is confined between a wall defined by said insert plate and a wall defined by said handle terminal portion.

5. In a slitter, the combination comprising a) a blade having a cutting edge, b) a holder for the blade, including a handle, and a terminal on the handle retaining the blade with the blade edge protruding, c) and a shield carried by the holder proximate said terminal, for movement between extended position in which the blade is protected, and retracted position in which the blade edge is exposed for cutting, d) the shield having two side plates movable adjacent opposite sides of said terminal, protective structure extending between said plates to extend beyond said blade in shield extended position, and a retainer interconnecting said plates, there being a pivot interconnection between said plates and said holder, proximate said retainer, e) and a stop on the holder limiting shield movement toward extended position.

6. The combination of claim 5 wherein said shield side plates have lower edges that extend below the blade cutting edge in shield-extended position.

7. The combination of claim 6 wherein said terminal has flat, opposite sides in sliding engagement with said side plates, said shield defining edges adapted for stabilizing engagement with a surface to be slit.

8. The combination of claim 5 wherein said retainer is a cross-piece integral with said shield side plates and which remains near an edge of the holder and near said pivot during pivoting of the shield between said extended and retracted positions.

9. The combination of claim 8 wherein said side plates have integral connection, spaced from the cross-piece to move together.

10. The combination of claim 1 wherein said holder and said shield consist of molded plastic material, whereby the holder, the shield and the blade are of throw-away construction.

11. The combination of claim 5 wherein said stop is near said retainer.

12. In a slitter, the combination comprising a) a blade having a cutting edge, b) a holder for the blade, including a handle, and a terminal on the handle retaining the blade with the blade edge protruding, c) and a shield carried by the holder proximate said terminal, for movement between extended position in which the blade is protected, and retracted position in which the blade edge is exposed for cutting, d) the shield having two side plates movable adjacent opposite sides of said terminal, protective structure extending between said plates to extend beyond said blade in shield extended position, and a retainer interconnecting said plates, there being a pivot interconnection between said plates and said holder, proximate said retainer, e) and wherein the holder includes an insert plate carried by said terminal, the blade carried adjacent the insert plate with the blade edge projecting in skewed relation to lower corners of the side plates interconnected by said retainer, in shield retracted position.

13. The combination of claim 12 including a stop on the holder limiting shield movement toward extended position.

* * * * *